US011261546B2

(12) United States Patent
Atkinson

(10) Patent No.: US 11,261,546 B2
(45) Date of Patent: Mar. 1, 2022

(54) BLENDED FIBER YARNS AND FABRICS INCLUDING OXIDIZED POLYMERIC FIBERS

(71) Applicant: National Safety Apparel, Inc., Cleveland, OH (US)

(72) Inventor: Zeb W. Atkinson, Spartanburg, SC (US)

(73) Assignee: NATIONAL SAFETY APPAREL, INC., Cleveland, OH (US)

( * ) Notice: Subject to any disclaimer, the term of this patent is extended or adjusted under 35 U.S.C. 154(b) by 12 days.

(21) Appl. No.: 16/118,255

(22) Filed: Aug. 30, 2018

(65) Prior Publication Data

US 2018/0371648 A1 Dec. 27, 2018

Related U.S. Application Data

(63) Continuation of application No. 14/839,155, filed on Aug. 28, 2015, now Pat. No. 10,240,263, which is a continuation of application No. 12/910,275, filed on Oct. 22, 2010, now abandoned.

(60) Provisional application No. 61/254,493, filed on Oct. 29, 2009.

(51) Int. Cl.

| | |
|---|---|
| ***D02G 3/44*** | (2006.01) |
| ***D03D 15/513*** | (2021.01) |
| ***D01G 13/00*** | (2006.01) |
| ***D01G 25/00*** | (2006.01) |
| ***D02G 3/04*** | (2006.01) |
| ***D04H 1/425*** | (2012.01) |
| ***D04H 1/70*** | (2012.01) |

(52) U.S. Cl.

CPC ..... *D02G 3/443* (2013.01); *D01G 13/00* (2013.01); *D01G 25/00* (2013.01); *D02G 3/04* (2013.01); *D03D 15/513* (2021.01); *D04H 1/425* (2013.01); *D04H 1/70* (2013.01); *D10B 2101/20* (2013.01); *D10B 2201/20* (2013.01); *D10B 2211/02* (2013.01); *D10B 2321/041* (2013.01); *D10B 2321/10* (2013.01); *D10B 2321/101* (2013.01); *D10B 2331/021* (2013.01); *D10B 2331/14* (2013.01); *Y10T 442/3146* (2015.04)

(58) Field of Classification Search

CPC ..... D02G 3/443

See application file for complete search history.

(56) References Cited

U.S. PATENT DOCUMENTS

| | | | |
|---|---|---|---|
| 4,837,076 | A | 6/1989 | McCullough, Jr. et al. |
| 4,865,906 | A | 9/1989 | Smith, Jr. |
| 4,900,613 | A | 2/1990 | Green |
| 4,970,111 | A | 11/1990 | Smith, Jr. |
| 5,506,043 | A | 4/1996 | Lilani |
| 5,763,103 | A | 6/1998 | McCullough |
| 6,287,686 | B1 | 9/2001 | Huang et al. |
| 6,358,608 | B1 | 3/2002 | Hanyon et al. |
| 6,627,122 | B1 | 9/2003 | Tada et al. |
| 6,800,367 | B2 | 10/2004 | Hanyon et al. |
| 7,087,300 | B2 | 8/2006 | Hanyon et al. |
| 7,534,854 | B1 | 5/2009 | Paulauskas et al. |
| 2004/0091705 | A1 | 5/2004 | Hanyon et al. |
| 2004/0198125 | A1 | 10/2004 | Mater et al. |
| 2006/0264136 | A1 | 11/2006 | Chiantese |
| 2007/0231573 | A1 | 10/2007 | Thatcher |
| 2008/0057807 | A1 | 3/2008 | Tutterow et al. |
| 2008/0113175 | A1 | 5/2008 | Ke |
| 2011/0104466 | A1 | 5/2011 | Atkinson |
| 2016/0053411 | A1 | 2/2016 | Atkinson |

FOREIGN PATENT DOCUMENTS

| | | | |
|---|---|---|---|
| CN | 1152342 | A | 6/1997 |
| JP | 2001-271231 | A | 10/2001 |
| WO | WO-2001/092613 | A1 | 12/2001 |

OTHER PUBLICATIONS

International Search Report dated Jul. 27, 2011 for application PCT/US10/53723, filed on Oct. 22, 2010 and published as WO 2011/050257 on Apr. 28, 2011 (Applicant—Invista Tech. S.A. R.L. // Inventor—Atkinson) (3 pages).

(Continued)

*Primary Examiner* — Andrew T Piziali

(74) *Attorney, Agent, or Firm* — Benesch, Friedlander, Coplan & Aronoff LLP

(57) ABSTRACT

An article comprising a fabric comprising:

(a) a blended yarn comprising:

(i) from about 10% to about 85% by weight of at least one biregional fiber comprising an oxidized polymer selected from the group consisting of acrylonitrile based homopolymers, acrylonitrile based copolymers, acrylonitrile based terpolymers, and combinations thereof;

(ii) at least one companion fiber selected from the group consisting of FR polyester, FR nylon, FR rayon, FR treated cellulose, m-aramid, p-aramid, modacrylic, novoloid, melamine, wool, nylon, regenerated cellulose, polyvinyl chloride, antistatic fiber, poly(p-phenylene benzobisoxazole) (PBO), polybenzimidazole (PBI), polysulphonamide (PSA), and combinations thereof; and (b) optionally including a companion yarn different from said blended yarn; wherein said companion yarn includes p-aramid in an amount less than 20% of the fabric weight; and wherein the fabric has a weight from about 3 oz/yd$^2$ to about 12 oz/yd$^2$.

17 Claims, No Drawings

(56) References Cited

OTHER PUBLICATIONS

Written Opinion dated Jul. 27, 2011 for application PCT/US10/53723, filed on Oct. 22, 2010 and published as WO 2011/050257 on Apr. 28, 2011 (Applicant—Invista Tech. S.A. R.L. //Inventor—Atkinson) (4 pages).
International Preliminary Report on Patentability dated Apr. 24, 2012 for application PCT/US10/53723, filed on Oct. 22, 2010 and published as WO 2011/050257 on Apr. 28, 2011 (Applicant—Invista Tech. S.A. R.L. // Inventor—Atkinson) (5 pages).
Requirement for Restriction or Election dated Sep. 25, 2012 for U.S. Appl. No. 12/910,275, filed Oct. 22, 2010 and published as US-2011-0104466-A1 on May 5, 2011 (Inventor—Atkinson) (13 pages).
Response to Requirement for Restriction or Election filed on Jan. 26, 2013 for U.S. Appl. No. 12/910,275, filed Oct. 22, 2010 and published as US-2011-0104466-A1 dated May 5, 2011 (Inventor—Atkinson) (2 pages).
Non-Final Office Action dated Apr. 8, 2013 for U.S. Appl. No. 12/910,275, filed Oct. 22, 2010 and published as US-2011-0104466-A1 on May 5, 2011 (Inventor—Atkinson) (9 pages).
Response to Non-Final Office Action filed on Apr. 8, 2013 for U.S. Appl. No. 12/910,275, filed Oct. 22, 2010 and published as US-2011-0104466-A1 dated May 5, 2011 (Inventor—Atkinson) (10 pages).
Final Office Action dated Oct. 9, 2013 for U.S. Appl. No. 12/910,275, filed Oct. 22, 2010 and published as US-2011-0104466-A1 on May 5, 2011 (Inventor—Atkinson) (9 pages).
Response to Final Office Action filed on Feb. 10, 2014 for U.S. Appl. No. 12/910,275, filed Oct. 22, 2010 and published as US-2011-0104466-A1 dated May 5, 2011 (Inventor—Atkinson) (10 pages).
Advisory Action dated Feb. 20, 2014 for U.S. Appl. No. 12/910,275, filed Oct. 22, 2010 and published as US-2011-0104466-A1 on May 5, 2011 (Inventor—Atkinson) (3 pages).
Non-Final Office Action dated Dec. 5, 2014 for U.S. Appl. No. 12/910,275, filed Oct. 22, 2010 and published as US-2011-0104466-A1 on May 5, 2011 (Inventor—Atkinson) (9 pages).
Response to Non-Final Office Action filed on Feb. 5, 2015 for U.S. Appl. No. 12/910,275, filed Oct. 22, 2010 and published as US-2011-0104466-A1 dated May 5, 2011 (Inventor—Atkinson) (11 pages).
Non-Final Office Action dated Mar. 2, 2015 for U.S. Appl. No. 12/910,275, filed Oct. 22, 2010 and published as US-2011-0104466-A1 on May 5, 2011 (Inventor—Atkinson) (9 pages).
Requirement for Restriction/Election dated Apr. 7, 2017 by the USPTO for U.S. Appl. No. 14/839,155, which was filed on Aug. 28, 2015 and published as US 2016/0053411 A1 on Feb. 25, 2016 (Inventor—Zeb W. Atkinson) (13 pages).
Response to Requirement for Restriction/Election dated Sep. 5, 2017 to the USPTO for U.S. Appl. No. 14/839,155, which was filed on Aug. 28, 2015 and published as US 2016/0053411 A1 on Feb. 25, 2016 (Inventor—Zeb W. Atkinson) (9 pages).
Final Rejection dated Oct. 27, 2017 by the USPTO for U.S. Appl. No. 14/839,155, which was filed on Aug. 28, 2015 and published as US 2016/0053411 A1 on Feb. 25, 2016 (Inventor—Zeb W. Atkinson) (9 pages).
Non-Final Office Action dated Feb. 28, 2013 for U.S. Appl. No. 12/868,809, filed Aug. 26, 2010 (Applicant—National Safety Apparel, Inc. // Inventor—Jung-Huang (Jason) Tsai, et al.) (9 pages).
Response to Non-Final Office Action filed on May 28, 2013 for U.S. Appl. No. 12/868,809, filed Aug. 26, 2010 (Applicant—National Safety Apparel, Inc. // Inventor—Jung-Huang (Jason) Tsai, et al.) (9 pages).
Final Office Action dated Sep. 30, 2013 for U.S. Appl. No. 12/868,809, filed Aug. 26, 2010 (Applicant—National Safety Apparel, Inc. // Inventor—Jung-Huang (Jason) Tsai, et al.) (12 pages).
Response to Final Office Action filed on Sep. 24, 2014 for U.S. Appl. No. 12/868,809, filed Aug. 26, 2010 (Applicant—National Safety Apparel, Inc. // Inventor—Jung-Huang (Jason) Tsai, et al.) (6 pages).
Non-Final Office Action dated May 21, 2015 for U.S. Appl. No. 12/868,809, filed Aug. 26, 2010 (Applicant—National Safety Apparel, Inc. // Inventor—Jung-Huang (Jason) Tsai, et al.) (17 pages).
Response to Non-Final Office Action filed on May 21, 2015 for U.S. Appl. No. 12/868,809, filed Aug. 26, 2010 (Applicant—National Safety Apparel, Inc. // Inventor—Jung-Huang (Jason) Tsai, et al.) (5 pages).
Final Office Action dated Feb. 8, 2015 for U.S. Appl. No. 12/868,809, filed Aug. 26, 2010 (Applicant—National Safety Apparel, Inc. // Inventor—Jung-Huang (Jason) Tsai, et al.) (12 pages).
Response to Final Office Action filed on Feb. 8, 2015 for U.S. Appl. No. 12/868,809, filed Aug. 26, 2010 (Applicant—National Safety Apparel, Inc. // Inventor—Jung-Huang (Jason) Tsai, et al.) (10 pages).
Non-Final Office Action dated Nov. 16, 2016 for U.S. Appl. No. 12/868,809, filed Aug. 26, 2010 (Applicant—National Safety Apparel, Inc. // Inventor—Jung-Huang (Jason) Tsai, et al.) (11 pages).
Final Rejection dated Jun. 1, 2017 by the USPTO for U.S. Appl. No. 12/868,809, filed Aug. 26, 2010 (Applicant—National Safety Apparel, Inc. // Inventor—Jung-Huang (Jason) Tsai, et al.) (12 pages).
Non-Final Office Action dated Dec. 29, 2017 for U.S. Appl. No. 12/868,809, filed Aug. 26, 2010 (Applicant—National Safety Apparel, Inc. // Inventor—Jung-Huang (Jason) Tsai, et al.) (10 pages).
Notice of Allowance dated Aug. 30, 2018 by the U.S. Patent and Trademark Office for U.S. Appl. No. 12/868,809, which was filed on Aug. 26, 2010 (Inventor—Tsai et al.; Applicant—National Safety Apparel, Inc.) (7 pages).
Preliminary Amendment filed on Dec. 13, 2018 with the U.S. Patent and Trademark Office for U.S. Appl. No. 16/119,632, which was filed on Aug. 31, 2018 and published as US 2018/0371649 dated Dec. 27, 2018 (Inventor—Tsai et al.; Applicant—National Safety Apparel, Inc.) (8 pages).
U.S. Appl. No. 12/868,809 (U.S. Pat. No. 10,094,052), filed Aug. 26, 2010 (Oct. 9, 2018), Jung-Huang Tsai (National Safety Apparel, Inc.).
U.S. Appl. No. 16/119,632 (2018/0371649), filed Aug. 31, 2018 (Dec. 27, 2018), Jung-Huang Tsai (National Safety Apparel, Inc.).

BLENDED FIBER YARNS AND FABRICS INCLUDING OXIDIZED POLYMERIC FIBERS

CROSS-REFERENCE TO RELATED APPLICATION

This application is a continuation application of U.S. Non-Provisional application Ser. No. 14/839,155 filed on Aug. 28, 2015, which is a continuation application of U.S. Non-Provisional application Ser. No. 12/910,275, filed on Oct. 10, 2010, which claims priority to U.S. Provisional Application No. 61/254,493, filed on Oct. 23, 2009, which is entirely incorporated herein by reference.

FIELD OF THE INVENTION

The present invention provides textile articles, which include a blended yarn having from 10% to 85% by weight of an oxidized polymeric biregional fiber such as an oxidized polyacrylonitrile. The yarn is blended with at least one companion fiber. The textile articles have a weight of from about 3 oz/yd$^2$ to about 12 oz/yd$^2$.

BACKGROUND OF RELATED TECHNOLOGY

There is a continuing need to improve the flame, heat, and electric arc flash protection of industrial clothing such as that worn by petro-chemical workers, pilots, firefighters, electrical workers, and steelworkers, among others. This is particularly critical for personnel who are frequently at close quarters where heat, flame and electrical arc flash hazards occur. Select military end uses also have value for such garments. The primary line of protection is the fabric in the protective clothing worn by the individual. Also important is that the clothing look good and feel comfortable, to ensure that it will be worn by the individual facing these hazards.

Flame retardant or flame resistant fibers, which can include oxidized polyacrylonitrile fibers, provide excellent heat and flame resistance. However, some challenges when working with such fibers can include brittleness, poor textile processing, and non-durable textile materials. By contrast, conventional natural and synthetic fibers (including the range from staple to continuous filament), are suitable for preparation of clothing fabrics, but lack flame resistant and/or flame retardant properties.

U.S. Pat. No. 5,763,103 to McCullough describes flame retardant and flame resistant yarns including a biregional carbonaceous fiber which is prepared from what is referred to as a biregional precursor fiber. The biregional precursor fiber includes a sheath of an oxidation stabilized thermoset polymeric material. The biregional carbonaceous fiber is prepared by the "carbonization" of the biregional precursor fiber where the fiber is exposed to an elevated temperature in an inert atmosphere to provide new carbon-to-carbon linkages resulting in what is described as McCullough's biregional carbonaceous fiber.

SUMMARY OF THE INVENTION

There is a need for fabrics that combine the superior heat and flame resistance of the flame resistant/retardant fibers in a fabric that provides the look and feel of fabrics prepared from conventional yarns. Oxidized polymeric fibers such as the biregional precursor fibers used to prepare biregional carbonaceous fibers in McCullough, can be blended with other fibers to provide yarns and fabrics with superior heat and flame resistance as well as fabric properties similar to conventional yarns making them suitable for garments.

In some embodiments are fabrics, such as knit, woven, and nonwoven fabrics that provide resistance to heat and flame. Such fabrics are useful for protective industrial clothing where the wearer may be subjected to heat, flame, and electrical hazards. These fabrics include a blended yarn including an oxidized polymeric fiber selected from the group consisting of acrylonitrile based homopolymers, acrylonitrile based copolymers, acrylonitrile based terpolymers, and combinations thereof.

In another embodiment is an article including a woven fabric including a blended yarn and optionally a companion yarn. The blended yarn includes:

(i) from about 10% to about 85% by weight of at least one biregional fiber including an oxidized polymer selected from the group consisting of acrylonitrile based homopolymers, acrylonitrile based copolymers, acrylonitrile based terpolymers, and combinations thereof;

(ii) at least one companion fiber selected from the group consisting of FR polyester, FR nylon, FR rayon, FR treated cellulose, m-aramid, p-aramid, modacrylic, novoloid, melamine, wool, nylon, regenerated cellulose (lyocell, modal, viscose), polyvinyl chloride, antistatic fiber, metallic fiber, poly(p-phenylene benzobisoxazole) (PBO), polybenzimidazole (PBI), polysulphonamide (PSA), and combinations thereof; and optionally including a companion yarn different from said blended yarn; wherein said companion yarn includes p-aramid in an amount less than 20% of the fabric weight (i.e., from 0% to 20% by weight of the fabric); and wherein the fabric has a weight from about 3 oz/yd$^2$ to about 12 oz/yd$^2$.

The blended yarn may further include a fiber comprising an oxidized polymer which is substantially uniformly oxidized throughout the cross-section of the fiber.

A method of some embodiments includes:

(a) providing at least one fiber including an oxidized polymer selected from the group consisting of acrylonitrile based homopolymers, acrylonitrile based copolymers, acrylonitrile based terpolymers, and combinations thereof;

(b) providing at least one companion fiber selected from the group consisting of FR polyester, FR nylon, FR rayon, FR treated cellulose, m-aramid, p-aramid, modacrylic, novoloid, melamine, wool, nylon, regenerated cellulose (lyocell, modal, viscose), polyvinyl chloride, antistatic fiber, metallic fiber, poly(p-phenylene benzobisoxazole) (PBO), polybenzimidazole (PBI), polysulphonamide (PSA), and combinations thereof; and (c) combining the fiber including oxidized polymeric fiber and the at least one companion fiber to form a yarn;

wherein the fiber including oxidized polymer is present in an amount from about 10% to about 85% by weight of the yarn.

In some embodiments is an article including a blended yarn. The blended yarn includes at least one oxidized polymeric fiber and at least three companion fibers selected from the group consisting of FR polyester, FR nylon, FR rayon, FR treated cellulose, m-aramid, p-aramid, modacrylic, novoloid, melamine, wool, nylon, regenerated cellulose (lyocell, modal, viscose), polyvinyl chloride, antistatic fiber, steel fiber, (poly(p-phenylene benzobisoxazole) (PBO), polybenzimidazole (FBI), polysulphonamide (PSA), and combinations thereof; wherein the article is a woven fabric and meets the standards for HRC level 2.

In some embodiments is an article including a blended yarn which includes at least one heat resistant fiber such as oxidized polymeric fiber. The yarn is included in an article such as a fabric having a fabric weight less than 7.5 oz/yd$^2$ and an arc rating of 8 or higher according to ASTM F1959, "Standard Test Method for Determining the Arc Rating of Materials for Clothing" and meets the performance standards for HRC 2.

DETAILED DESCRIPTION OF THE INVENTION

As used herein, the terms blend or blended, in referring to a spun yarn, means a mixture of fibers of at least two types, wherein the mixture is formed in such a way that the individual fibers of each type of fiber are substantially completely intermixed with individual fibers of the other types to provide a substantially homogeneous mixture of fibers, having sufficient entanglement to maintain its integrity in further processing and use.

As used herein, the term "biregional fiber" includes fibers where the cross-section shows a distinguishable inner core and an outer sheath. For the oxidized biregional fiber, the sheath substantially constitutes the oxidized portion of the fiber.

The heat resistant fiber such as the oxidized polymeric fiber may be combined with other yarns or fibers in other yarn constructions. These examples include covering the oxidized polymeric fiber with other yarns such as by twisting with another yarn, single or double wrapping, and core-spinning, among others. The oxidized polymeric fiber may form either the core or the sheath (the covering).

Antistatic fibers which can be useful as (1) a companion fiber with the oxidized polymeric fiber or (2) can be included as or contained within, a companion yarn are known to those of skill in the art. Useful antistatic fibers include, but are not limited to metallic or other electrically conductive yarns and fibers. Yarns and fibers can include an antistatic coating or can be wrapped with a fiber or yarn having antistatic properties.

Some embodiments provide fabrics such as woven, knit or nonwoven fabrics that include a yarn with at least one oxidized polymeric fiber such as a biregional fiber. The fabrics may be used in garments, insulation or any other end uses where the fabrics can provide benefit. Examples of suitable oxidized polymeric fibers are selected from the group consisting of acrylonitrile based homopolymers, acrylonitrile based copolymers, acrylonitrile based terpolymers, and combinations thereof. One suitable polymer for the oxidized polymer is polyacrylonitrile. The oxidized polymeric fibers are combined with one or more companion fibers to provide a blended yarn.

Where the fabric has a woven construction, this includes, but is not limited to, plain weave, twill, satin, basket as well as more durable fabrics such as those with a rip stop construction. Where the fabric is woven, it can include a p-aramid as a companion yarn or blended in a companion yarn an amount less than 20% of the fabric weight. The woven fabric may include any other companion yarns described herein.

Knit fabrics are also contemplated that have a fabric construction including, but not limited to, weft knit such as circular knit and warp knit. These knits may include a companion yarn in addition to the blended yarn which includes an oxidized polymeric fiber, such as an oxidized polymeric biregional fiber.

Where the fabric is a nonwoven fabric blended yarns may include oxidized polymeric biregional fiber in combination with other yarns. Nonwoven fabrics are especially suitable for insulation.

The oxidized polymer may be either substantially oxidized throughout the cross-section of the fiber or may be a biregional fiber. The biregional fiber may have an unoxidized polymeric core and an oxidized polymeric sheath.

Oxidization of the polymeric fiber may occur according to any suitable method. One suitable method of oxidizing a polymeric fiber such as polyacrylonitrile (PAN) includes introducing the fiber into an oxidizing atmosphere under tension at a moderately elevated temperature of from about 150° C. to about 350° C. for a polymer such as polyacrylonitrile (PAN). The fiber will remain in the oxidizing atmosphere for a sufficient time to achieve the desired level of permeation of oxygen into the fiber (sheath oxidization or complete oxidization). The oxidized polymer may be used in any suitable denier such as from about 1 to about 6 denier, including from about 2 to about 6 denier.

The companion fibers included in the blended yarn, in addition to the oxidized polymeric fiber, can be any fiber suitable for apparel yarns and fabrics. The companion fibers may also provide heat resistant properties. Specific examples of useful companion fibers include FR polyester, FR nylon, FR rayon, FR treated cellulose, m-aramid, p-aramid, modacrylic, novoloid, melamine, wool, nylon (in staple or filament form), regenerated cellulose (lyocell, modal, viscose), polyvinyl chloride, antistatic fiber, poly(p-phenylene benzobisoxazole (PBO), polybenzimidazole (P131), polysulphonamide (PSA) and combinations thereof.

In the blended yarn useful in some embodiments, which includes an oxidized polymeric fiber, the weight percent of the different fiber components may vary. The oxidized polymeric fiber may be present in an amount from about 10% to about 90% by weight of the blended yarn, including from about 10% to about 85%, from about 15% to about 50%, from about 20% to about 60%, from about 20% to about 75%, from about 30% to about 85%, and from about 35% to about 65%. The weight percent of the companion fibers in the blend will vary depending on how many companion yarns are included and the desired properties of fabric. There may be one, two, three, four or more companion fibers in addition to the oxidized polymeric fiber. FR rayon may be present in an amount from 0 to about 60% by weight of the yarn, m-aramid may be present in an amount from 0 to about 30% by weight of the yarn, p-aramid may be present in an amount from 0 to about 40% by weight of the yarn, modacrylic may be present in an amount from 0 to about 40% by weight of the yarn, wool may be present in an amount from 0 to about 60% by weight of the yarn, nylon (as staple or filament) may be present in an amount from 0 to about 30% by weight of the yarn, polyvinyl chloride (PVC) may be present in an amount from 0 to about 20% by weight of the yarn, and antistatic or steel fiber may be present in an amount from 0 to about 10% by weight of the yarn. Other fibers may be included in suitable amounts that would be determinable by the person of skill in the art. Useful examples containing three companion fibers were included in the blend are (a) the combination of FR rayon, nylon, regenerated cellulose (lyocell, modal, viscose), and p-aramid; and (b) the combination of wool, modacrylic and nylon and regenerated cellulose (lyocell, modal, viscose).

The fabrics of some embodiments optionally include one or more companion yarns in addition to the blended yarn comprising the oxidized polymeric fiber. The article can include one or more companion yarns where the amount of p-aramid in the companion yarns is less than 20% by weight of the fabric. Examples of companion yarns include yarns comprised of fibers selected from the group consisting of FR polyester, FR nylon, FR rayon, FR treated cellulose, m-aramid, p-aramid, modacrylic, wool, nylon, regenerated cellulose (lyocell, modal, viscose), polyvinyl chloride, antistatic fiber, steel fiber, poly(p-phenylene benzobisoxazole (PBO), polybenzimidazole (FBI), polysulphonamide (PSA) and combinations thereof and combinations thereof. The companion yarns may include blended yarns, spun yarns, covered yarns, and twisted yarns, as well as filaments yarns. The companion yarn may also include a heat resistant fiber or yarn and can include an oxidized polymeric fiber.

The density of the oxidized polymeric fiber will vary depending on the extent of the oxidation. For example, the density may be from about 1.20 g/cm$^3$ to about 1.50 g/cm$^3$, including from 1.20 g/cm$^3$ to about 1.44 g/cm$^3$, about 1.30 g/cm$^3$ to about 1.44 g/cm$^3$ and, from about 1.20 g/cm$^3$ to about 1.40 g/cm$^3$. Where the oxidized polymeric fiber is only partially oxidized, a biregional fiber, such as a sheath-core fiber may result.

The core region, which is not oxidized may have radius (r), while the cross-section of the fiber may have radius (R). The ratio of the core region to the total radius of the fiber (r:R) will vary depending on the extent of the oxidation. This ratio (r:R) may vary from about 1:1.03 to about 1:7; such as from about 1:1.03 to about 1:1.4, from about 1:2 to about 1:9, from about 1:2 to about 1:6; and from about 1:1.05 to about 1:1.8, including from about 1:1.105 to about 1:1.4.

The fabrics of some embodiments can be prepared as lightweight fabrics while maintaining properties needed for industrial clothing. The fabrics can have a weight less than 12 oz/yd$^2$, including less than 7.5 oz/yd$^2$, about 3 oz/yd$^2$ to about 12 oz/yd$^2$, from about 3 oz/yd$^2$ to about 7.5 oz/yd$^2$, from about 4 oz/yd$^2$ to about 9 oz/yd$^2$, and from 3 oz/yd$^2$ to about 6.5 oz/yd$^2$.

The fabrics of some embodiments perform exceptionally well for certain industrial clothing applications, such as ASTM F1959, "Standard Test Method for Determining the Arc Rating of Materials for Clothing," where the fabrics either meet or exceed the standards while maintaining a low fabric weight. It is understood that the heavier the fabric, the better it will perform for protection from hazards such as heat, chemical, electric, etc. However, the fabrics of some embodiments can have an arc rating of 8 or greater, including an arc rating of 9 or greater. The arc rating of 9 can be achieved with a fabric of 7.5 oz/yd$^2$ or less such as from about 6.5 oz/yd$^2$ to about 7.5 oz/yd$^2$. These properties are very important for garments for which the combination of lightweight and protective fabrics is needed for industrial uses where the wearer of the garment may be subjected to hazardous conditions. The fabrics or garments may also be dyed when desired.

The fabrics of some embodiments can have other beneficial properties in addition to meeting the standards for arc rating described above. The fabrics of some embodiments can provide a Vertical flammability char length <4 in (per test method ASTM D6413), Thermal protective performance rating (spaced) >10 cal/cm$^2$, and thermal manikin % body burn <50% (per test method ASTM F1930) when tested in accordance with National Fire Protection Association Standard (NFPA) 2112 (2007), "Standard on Flame-Resistance Garments for Protection of Industrial Personnel Against Flash Fire."

The yarns including the oxidized polymeric fiber can be prepared by any suitable yarn spinning process, such as those conventionally used for staple fibers.

Examples of useful processes include the spinning processes typically used for wool to make wool yarns. Accordingly, the yarns used in some embodiments may be blended worsted yarns, or in other words, yarns made on a worsted spinning system. These yarns may be prepared using worsted carding or using a converted tow. Process used for short fibers including staple fibers, such as cotton, can also be useful.

The features and advantages of the present invention are more fully shown by the following examples which are provided for purposes of illustration, and are not to be construed as limiting the invention in any way.

EXAMPLES

Test Methods: Test methods and minimum requirements for thermal protection include:

a. ASTM D6413: Test method for Flame Resistance of Textiles (Vertical Test)
b. NFPA 2112: (National Fire Protection Association) Standard on Flame-Resistant Garments for Protection of Industrial Personnel Against Flash Fire. Section 8.2 (Thermal Protective Performance Test)
c. NFPA 1977: (National Fire Protection Association) Standard on Protective Clothing and Equipment for Wildland Fire Fighting.
d. NAFPA 1951: (National Fire Protection Association) Standard on Protective Ensembles for Technical Rescue Incidents.
e. ASTM F1930: Test Method for Evaluation of Flame Resistant Clothing for Protection Against Flash Fire Simulations Using an Instrumented Manikin
f. ASTM F1959: Standard Test Method for Determining the Arc Rating of Materials for Clothing The following tables include fabric samples (TABLE 1) and the results (TABLES 2-4) according to each testing method. The fabrics were prepared as a twill using only the blended yarn including the fibers indicated in TABLE 1. The minimal requirements for each test method are included for comparison. Each of the inventive fabrics (1), (2), (3), and (4), respectively, met the minimum criteria required for its intended end use application.

TABLE 1

| | FABRICS | | | |
|---|---|---|---|---|
| | 1 | 2 | 3 | 4 |
| Fabric weight, oz/yd | 5.5 | 6.2 | 6.8 | 8.5 |
| Fabric composition by weight | 35% FR rayon<br>22% oxidized biregional PAN<br>22% modacrylic<br>6% polyamide<br>15% p-aramid | 35% FR rayon<br>24% oxidized biregional PAN<br>20% modacrylic<br>6% polyamide<br>15% p-aramid | 54% oxidized biregional PAN<br>20% FR rayon<br>16% m-aramid<br>9% polyamide<br>1% antistat | 44% oxidized biregional PAN<br>18% p-aramid<br>16% FR rayon<br>12% PVC<br>10% polyamide |

TABLE 2

| TEST RESULTS NFPA 70E (Electrical Workers) | | | | |
|---|---|---|---|---|
| | Minimum Requirements | Fabric 1 | Fabric 2 | Fabric 3 |
| ATPV | >8 | 8.9 | 10.7 | 10.8 |
| HRC Class | | HRC-2 | HRC-2 | HRC-2 |
| Arc Rating | | | | |

TABLE 3

| TEST RESULTS NFPA 2112 (Chemical Workers) | | | | |
|---|---|---|---|---|
| | Minimum Requirements | Fabric 1 | Fabric 2 | Fabric 3 |
| Vertical Flammability Afterflame, W × F[1] | <2 sec AF | 0 × 0 | 0 × 0 | 0 × 0 |
| Vertical Flammability Char Length, W × F[1] | <4" char length | 0.8 × 1.2 | 2.7 × 3.3 | 2.8 × 1.8 |
| TST Shrinkage (500° F./ 5 min.) as received), W × F[1] | <10% | 5.8 × 6.7 | 4.4 × 7.7 | 9.9 × 5.2 |
| TST Shrinkage (500° F./5 min.) after 3 launderings, W × F[1] | <10% | 7.2 × 7.6 | 5.6 × 6.7 | 8.2 × 6.1 |
| TPP (Thermal Protective Performance) as received Contact[2]/Spaced[3] | 3 cal/cm$^2$/$_6$ cal/cm$^2$ | 8.7/12.1 | 9.5/12.2 | 9.2 × 12.8 |
| TPP (Thermal Protective Performance) after 3 launderings Contact[2]/Spaced[3] | 3 cal/cm$^2$/$_6$ cal/cm$^2$ | 8.7/11.8 | 10.3/13.2 | 10.3/13.9 |
| % Manikin Body Burn | <50% | 27.0 | 21.6 | 24.0 |

[1]Warp × Fill
[2]Fabric in contact with thermal sensor
[3]Fabric spaced ¼ inch from thermal spacer

TABLE 4

| TEST RESULTS NFPA 1977 (Wildland Fire Fighters) | | |
|---|---|---|
| | Minimum Requirements | Fabric 4 |
| Vertical Flammability Afterflame, W × F[1] | <2 sec AF (after 100X washes @105° F.) | 0 |
| Vertical Flammability Char Length, W × F[1] | <4" char length (after 100X washes 105° F.) | 0.45" |
| TST Shrinkage (500° F./5 min.) | <10% (OX washes) | 3.9 × 4.8 |
| Radiant Protective Performance | >7 (after 5X washes @ 105° F.) | 9.7 |
| Heat Loss | >450 W/m$^2$ | 697 |
| Trap Tear Strength | >22N | 182 |
| Laundry Shrinkage, W × F[1] | <5% (after 5X washes @ 105° F.) | 3.0 × 1.4 |

[1]Warp × Fill

TABLE 5

| TEST RESULTS NFPA 1951 (Technical Rescue) | | |
|---|---|---|
| | Minimum Requirements | Fabric 4 |
| Vertical Flammability Afterflame, W × F' | <2 sec AF (before and 10X washes@140° F.) | 0 |
| Vertical Flammability Char Length, W × F' | <4" char length (before and after 10Xwashes @140° F.) | 0.45" |
| TST Shrinkage (500° F./5 min.), W × F' | <10% (before and after 10X washes @ 140° F.) | 3.9 × 4.8 |
| TPP (Thermal Protective Performance) Spaced[2] | >10 (after 10X washes @ 140° F.) | 18.7 |

TABLE 5-continued

| TEST RESULTS NFPA 1951 (Technical Rescue) | | |
|---|---|---|
| | Minimum Requirements | Fabric 4 |
| Heat Loss | >650 W/m$^2$ | 697 |
| Grab Tensile | >400N (after 10X washes @140° F.) | 622 |
| Trap Tear Strength | >30N (after 10X washes @140° F.) | 182 |
| Strength After Stoll Abrasion | >250N (after 500 abrasion cycles) | 378 |
| Laundry Shrinkage, W × F[1] | <5% (after 5X washes @140° F.) | 3.0 × 1.4 |

[1]Warp × Fill
[2]Fabric in contact with thermal sensor

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

What is claimed is:

1. A fabric comprising:

(a) a blended yarn comprising:

(i) from about 35% to about 65% by the blended yarn weight of at least one fiber comprising an oxidized polyacrylonitrile;

(ii) at least one companion fiber comprising p-aramid; wherein the blended yarn is present in a fill direction in the fabric; and (b) a companion yarn different from the blended yarn; wherein the companion yarn comprises:

(i) a staple fiber comprising p-aramid; and (ii) a staple fiber comprising m-aramid;

wherein the companion yarn different from the blended yarn is present in a warp direction in the fabric, and wherein the fabric has a weight from about 4 oz/yd$^2$ to about 9 oz/yd$^2$ and a ratio of the Thermal Protective Performance (TPP) to the weight is higher than 1.

2. The fabric of claim 1, wherein the ratio of the Thermal Protective Performance to the weight is at least 1.5.

3. The fabric of claim 1, wherein the ratio of the Thermal Protective Performance to the weight is about 2.

4. The fabric of claim 1, wherein the Thermal Protective Performance is greater than 8 to about 15.

5. The fabric of claim 1, wherein the fiber comprising the oxidized polyacrylonitrile is substantially uniformly oxidized throughout the cross-section of the fiber.

6. The fabric of claim 5, wherein the fiber comprising the oxidized polyacrylonitrile which is substantially uniformly oxidized has a density from about 1.30 g/cm$^3$ to about 1.44 g/cm$^3$.

7. The fabric of claim 1, wherein the oxidized polyacrylonitrile has a density from about 1.20 g/cm$^3$ to about 1.50 g/cm$^3$.

8. The fabric of claim 1, wherein the fabric exhibits a ratio of an arc rating according to ASTM F1959 to weight greater than 1.

9. The fabric of claim 1, wherein the fabric exhibits an arc rating according to ASTM F1959 that is greater than 8.

10. The fabric of claim 9, wherein the arc rating is greater than 9 and the fabric has a weight from about 6.5 oz/yd$^2$ to about 7.5 oz/yd$^2$.

11. The fabric of claim 1, wherein the fabric is dyeable.

12. The fabric of claim 1, wherein the fabric comprises a twill weave.

13. A method of making the fabric of claim 1, the method comprising:

forming a fabric comprising combining the blended yarn with the companion yarn different from the blended yarn.

14. An article comprising the fabric of claim 1.

15. A fabric comprising:

(a) a blended yarn comprising:

(i) from about 35% to about 65% by the blended yarn weight of at least one fiber comprising an oxidized polyacrylonitrile;

(ii) at least one companion fiber comprising p-aramid; wherein the blended yarn is present in a fill direction in the fabric; and (b) a companion yarn different from the blended yarn; wherein the companion yarn consists of staple fibers comprising:

(i) p-aramid; and (ii) m-aramid;

wherein the companion yarn different from the blended yarn is present in a warp direction in the fabric, wherein the fabric has a weight from about 4 oz/yd$^2$ to about 9 oz/yd$^2$ and a ratio of the Thermal Protective Performance (TPP) to the weight is higher than 1.

16. The fabric of claim 15, wherein the fiber comprising the oxidized polyacrylonitrile is substantially uniformly oxidized throughout the cross-section of the fiber.

17. An article comprising the fabric of claim 15.

* * * * *